US011501666B1

(12) United States Patent
Marston

(10) Patent No.: US 11,501,666 B1
(45) Date of Patent: Nov. 15, 2022

(54) SIGN MOUNTING SYSTEM AND METHOD OF USE THEREOF

(71) Applicant: Dale Marston, Montrose, AL (US)

(72) Inventor: Dale Marston, Montrose, AL (US)

( * ) Notice: Subject to any disclaimer, the term of this patent is extended or adjusted under 35 U.S.C. 154(b) by 0 days.

(21) Appl. No.: 17/387,894

(22) Filed: Jul. 28, 2021

(51) Int. Cl.
*G09F 7/18* (2006.01)

(52) U.S. Cl.
CPC ..... *G09F 7/18* (2013.01); *G09F 2007/1834* (2013.01); *G09F 2007/1856* (2013.01)

(58) Field of Classification Search
CPC ..... G09F 2007/1834; G09F 2007/1856; G09F 19/228
See application file for complete search history.

(56) References Cited

U.S. PATENT DOCUMENTS 1,629,229 A * 5/1927 Sharp, Jr. ..... G09F 7/18 40/607.05
1,664,415 A * 4/1928 Herzog ..... G09F 3/16 24/336
1,881,371 A * 10/1932 Gilbert ..... G09F 3/202 40/652
2,664,977 A * 1/1954 Starcevich ..... E21D 15/52 52/301
3,171,626 A * 3/1965 Keats ..... G09F 7/18 40/607.01
3,958,351 A * 5/1976 Summey ..... G09F 7/18 248/230.1
4,219,179 A * 8/1980 Silbernagel ..... G09F 7/18 40/607.04
4,717,110 A * 1/1988 Fohrman ..... G09F 7/20 40/607.1
5,903,991 A * 5/1999 Sasse ..... G09F 7/22 40/607.04
6,347,600 B1 * 2/2002 Duff, II ..... G09F 15/0025 40/607.1
6,807,782 B2 * 10/2004 Forman ..... E04F 19/00 40/607.1
7,503,135 B2 * 3/2009 Chafin ..... G09F 21/04 40/607.04
7,644,927 B2 * 1/2010 Law ..... F41J 1/10 40/607.1

(Continued)

OTHER PUBLICATIONS

Design U.S. Appl. No. 29/801,427, titled Sign Holder, filed Jul. 28, 2021, to Dale Marston.

*Primary Examiner* — David R Dunn
*Assistant Examiner* — Christopher E Veraa
(74) *Attorney, Agent, or Firm* — AdamsIP, LLC; Stephen Thompson; James Adams

(57) ABSTRACT

A system for mounting a sign on a stanchion and a method of using the system for mounting signs are provided. The system includes a bracket that can be mounted onto the upper end of the stanchion and a sign frame that can be mounted onto the bracket. The sign frame supports the sign in an upright position. The bracket has a base with an open lower end that can be lowered down onto the upper end of the stanchion to mount the bracket. The bracket has a support member attached to the base for mounting the sign frame onto the bracket. The support member has a pair of opposing openings that extend through the support member. The sign frame has a pair of frame mounting rods that can be inserted downward through the openings to mount the sign frame onto the bracket.

20 Claims, 7 Drawing Sheets

(56) References Cited

U.S. PATENT DOCUMENTS

| | | | | |
|---|---|---|---|---|
| 7,743,539 | B1 * | 6/2010 | Kennedy | G09F 15/0062 40/607.01 |
| 8,234,805 | B2 * | 8/2012 | Dukes | G09F 7/18 40/611.01 |
| 8,434,732 | B1 * | 5/2013 | Penn | B68C 1/002 119/512 |
| 8,677,663 | B1 * | 3/2014 | Tyszko | G09F 7/18 248/224.7 |
| 8,701,322 | B2 * | 4/2014 | Santarelli | G09F 3/14 40/659 |
| 9,275,563 | B1 * | 3/2016 | Hartman | G09F 15/0018 |
| D755,303 | S | 5/2016 | Bissonnette et al. | |
| 9,741,274 | B1 * | 8/2017 | Elmer | G09F 21/048 |
| 9,984,600 | B1 * | 5/2018 | Daly | G09F 7/22 |
| 10,565,907 | B1 * | 2/2020 | Trifone | G09F 11/02 |
| 10,679,526 | B1 * | 6/2020 | Ritter, Jr. | G09F 7/002 |
| 2001/0039750 | A1 | 11/2001 | Venegas | |
| 2005/0160647 | A1 * | 7/2005 | Brown | G09F 7/18 40/607.1 |
| 2006/0284033 | A1 * | 12/2006 | Wallis | A01K 3/00 248/127 |
| 2008/0307728 | A1 * | 12/2008 | Pato | E01F 9/60 52/301 |
| 2010/0132235 | A1 * | 6/2010 | Sarro | G09F 7/18 40/607.13 |
| 2010/0192434 | A1 * | 8/2010 | Smith | G09F 7/18 40/606.01 |
| 2012/0060398 | A1 * | 3/2012 | Bowman | G09F 7/04 40/600 |
| 2014/0259833 | A1 | 9/2014 | Smith et al. | |
| 2016/0335931 | A1 * | 11/2016 | Dalton | G09F 7/22 |

* cited by examiner

SIGN MOUNTING SYSTEM AND METHOD OF USE THEREOF

FIELD OF THE DISCLOSURE

The present disclosure relates generally to a system for mounting a sign on a stanchion and a method of using the system for mounting signs.

BACKGROUND

Signs may be mounted in a variety of ways to support a sign in an upright position for optimal viewing of sign graphics. Signs used as yard signs or roadside signs are often made of corrugated material and mounted on metal frames commonly referred to as H-frames, which typically have two downwardly pointing rods and two upwardly pointing rods. The downwardly pointing rods may simply be forced down into the ground to support the frame in an upright position, and the upwardly pointing rods can be inserted into the sign itself between the internal corrugations of the sign to support the sign in an upright position relative to the frame. These frames may be used to set up signs quickly and easily but also have certain disadvantages. For example, signs set up using H-frames are typically positioned at a relatively low height relative to the ground, which may limit the visibility of sign graphics as viewed by passersby. Because H-frames are typically constructed of small metal rods, which typically have some bendability, increasing the height of the frames sufficiently to position signs at certain heights may not be feasible.

Accordingly, a need exists in the art for an improved system for mounting a sign, as well as a method of using the system for mounting signs.

SUMMARY

In one aspect, a system for mounting a sign and a method of using the system for mounting signs are provided. The system comprises a bracket configured for mounting a sign on a stanchion and a sign frame configured for supporting a sign. The bracket may first be installed on an upper end of a vertical stanchion, and the sign frame supporting the sign may be installed onto the bracket so that the sign is positioned at a height above the upper end of the stanchion. The system may be utilized to install a sign onto any vertical stanchion, such as a fence post.

The bracket comprises a base having a hollow interior. The base preferably has a generally tubular shape that is vertically oriented when installed on a vertical stanchion. The base has an upper end and a lower end. The lower end of the base is open so that the bracket may be installed onto a vertical stanchion by inserting the upper end of the stanchion into the lower open end of the base. The upper end of the base is at least partially closed so that the upper end of the base functions as a stopper that rests upon the upper end of the stanchion, which supports the bracket on the upper end of the stanchion. The bracket further comprises a bracket support member attached to the base. The bracket support member is preferably a horizontally oriented member attached to the upper end of the base. The bracket support member has a pair of opposing openings that extend through the bracket support member.

The sign frame comprises a frame cross support member and two opposing frame mounting rods each attached to the frame cross support member. Each of the frame mounting rods extends downwardly from the frame cross support member. The frame mounting rods are spaced a distance apart from each other, which is approximately equal to the distance between the two opposing openings of the bracket support member. Each frame mounting rod is sized for insertion into one respective opening of the pair of openings. Thus, the sign frame may be installed onto the bracket by inserting the two frame mounting rods downward into the two openings of the bracket support member. In a preferred embodiment, the bracket support member may have additional pairs of openings at different spaced distances in order to accommodate sign frames of different sizes. Each sign frame may also have two opposing sign mounting rods each attached to the frame cross support member. Each of the sign mounting rods extends upwardly from the frame cross support member and may be used to support a sign by inserting the sign mounting rods into spaces between internal corrugations of the sign.

The foregoing summary has outlined some features of the system and method of the present disclosure so that those skilled in the pertinent art may better understand the detailed description that follows. Additional features that form the subject of the claims will be described hereinafter. Those skilled in the pertinent art should appreciate that they can readily utilize these features for designing or modifying other structures for carrying out the same purpose of the system and method disclosed herein. Those skilled in the pertinent art should also realize that such equivalent designs or modifications do not depart from the scope of the system and method of the present disclosure.

DESCRIPTION OF THE DRAWINGS

These and other features, aspects, and advantages of the present disclosure will become better understood with regard to the following description, appended claims, and accompanying drawings where:

DETAILED DESCRIPTION

In the Summary above and in this Detailed Description, and the claims below, and in the accompanying drawings, reference is made to particular features, including method steps, of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with/or in the context of other particular aspects of the embodiments of the invention, and in the invention generally.

The term "comprises" and grammatical equivalents thereof are used herein to mean that other components, steps, etc. are optionally present. For example, a system "comprising" components A, B, and C can contain only components A, B, and C, or can contain not only components A, B, and C, but also one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

Figure 11:
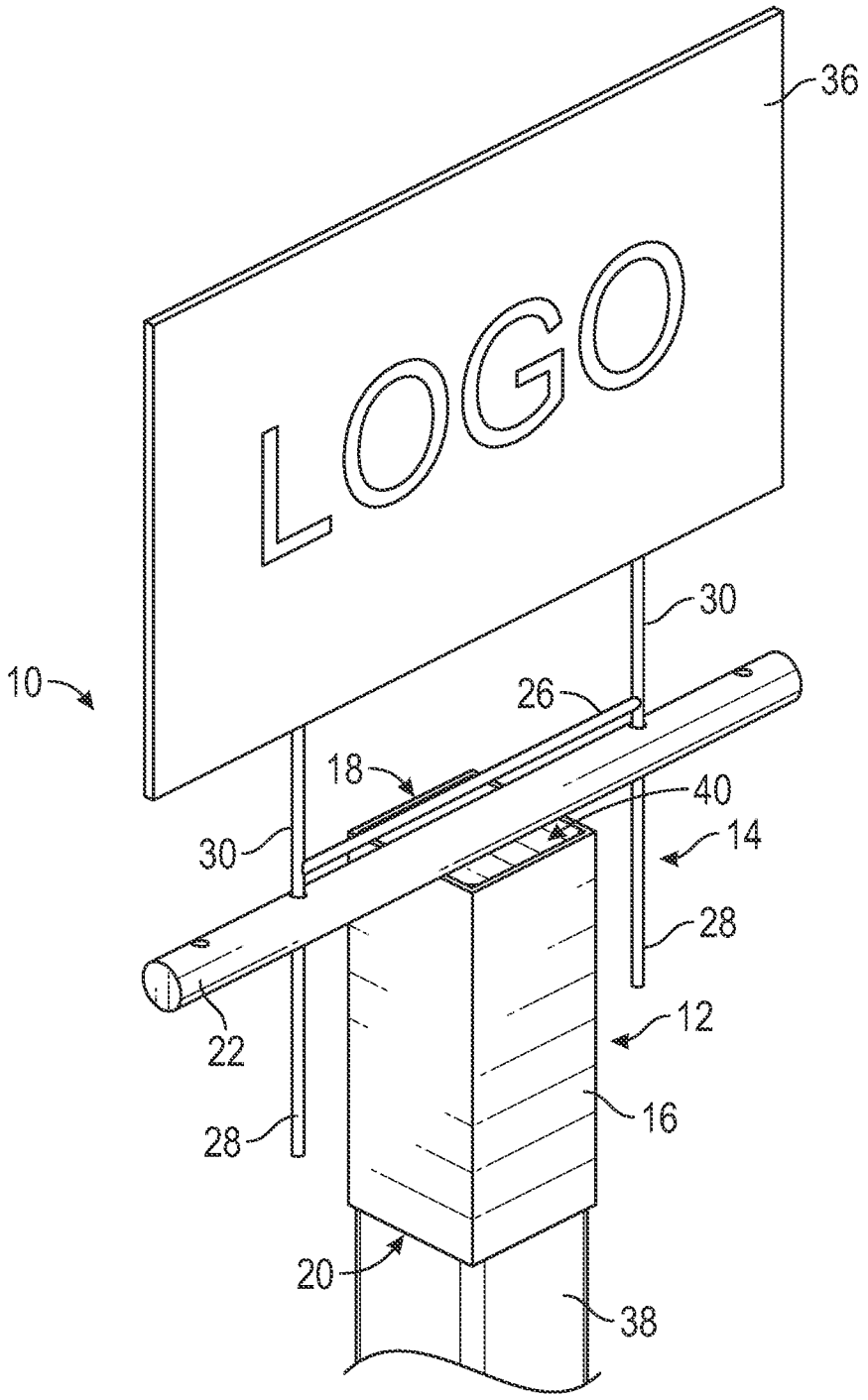
FIG. 11 is a partial perspective view of a sign mounted onto a vertical stanchion using a sign mounting system in accordance with the present disclosure.

In one aspect, a system 10 for mounting a sign 36 and a method of using the system 10 for mounting signs are provided. The system 10 comprises a bracket 12 configured for mounting a sign 36 onto a stanchion 38 and a sign frame 14 configured for supporting a sign 36. The bracket 12 may first be installed on an upper end 40 of a vertical stanchion 38, and the sign frame 14 supporting the sign 36 may be installed onto the bracket 12 so that the sign 36 is positioned at a height above the upper end 40 of the stanchion 38, as best seen in FIG. 11. The system 10 may be utilized to mount a sign onto any vertical stanchion 38, such as a fence post or any other suitable type of upright fixture having a generally vertical upper end.

Figure 1:
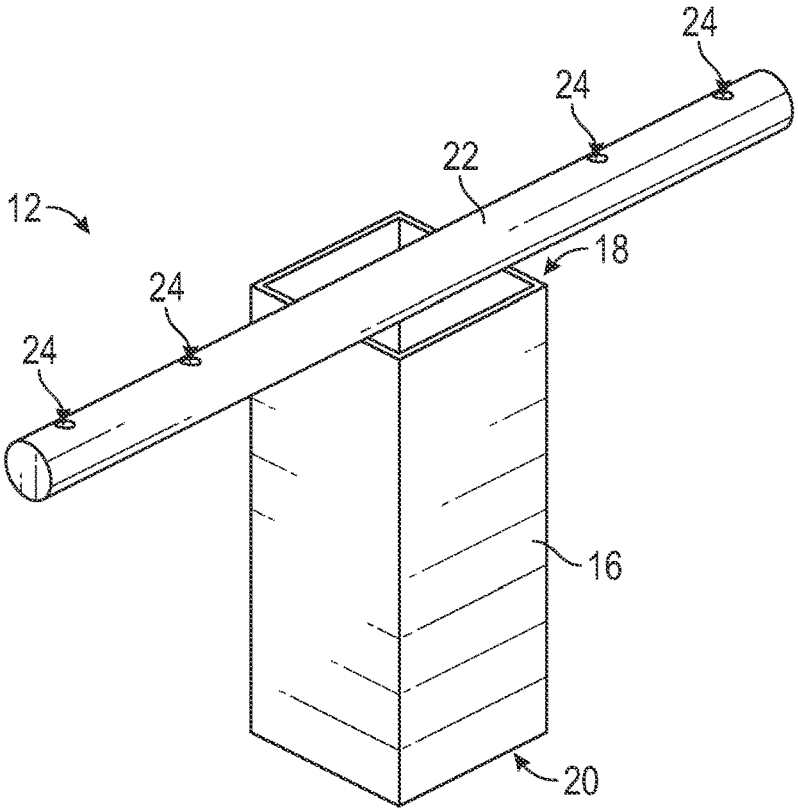
FIG. 1 is a perspective view of a bracket for use in a sign mounting system in accordance with the present disclosure.
Figure 2:
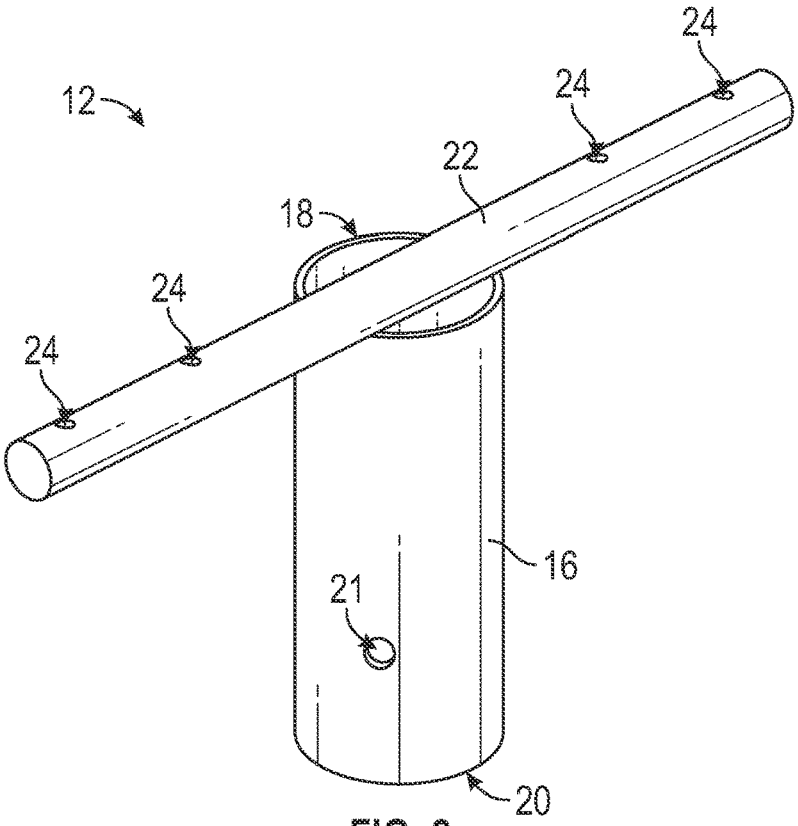
FIG. 2 is a perspective view of a bracket for use in a sign mounting system in accordance with the present disclosure.
Figure 4:
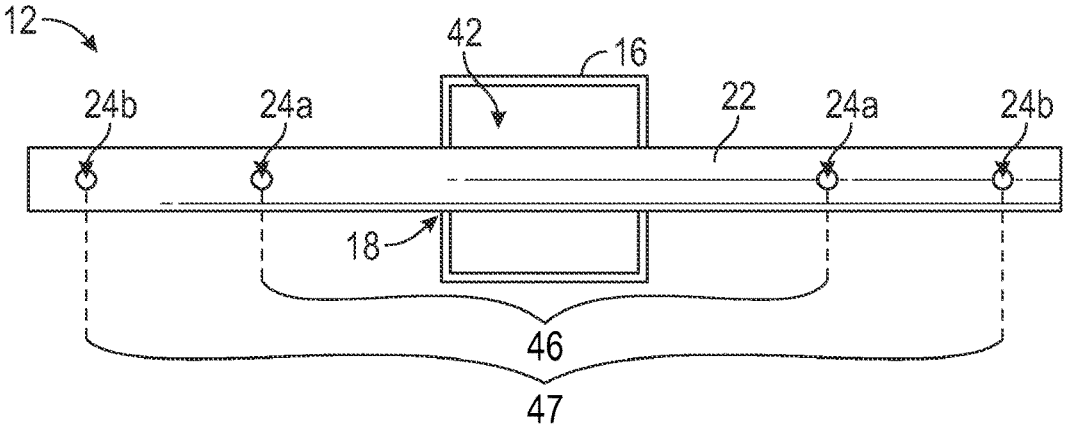
FIG. 4 is a top plan view of a bracket for use in a sign mounting system in accordance with the present disclosure.
Figure 5:
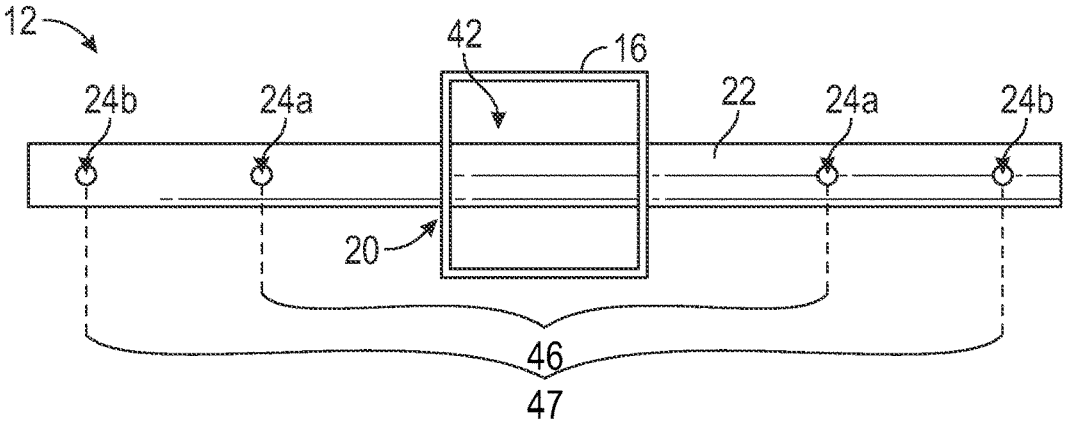
FIG. 5 is a bottom plan view of a bracket for use in a sign mounting system in accordance with the present disclosure.
Figure 9:
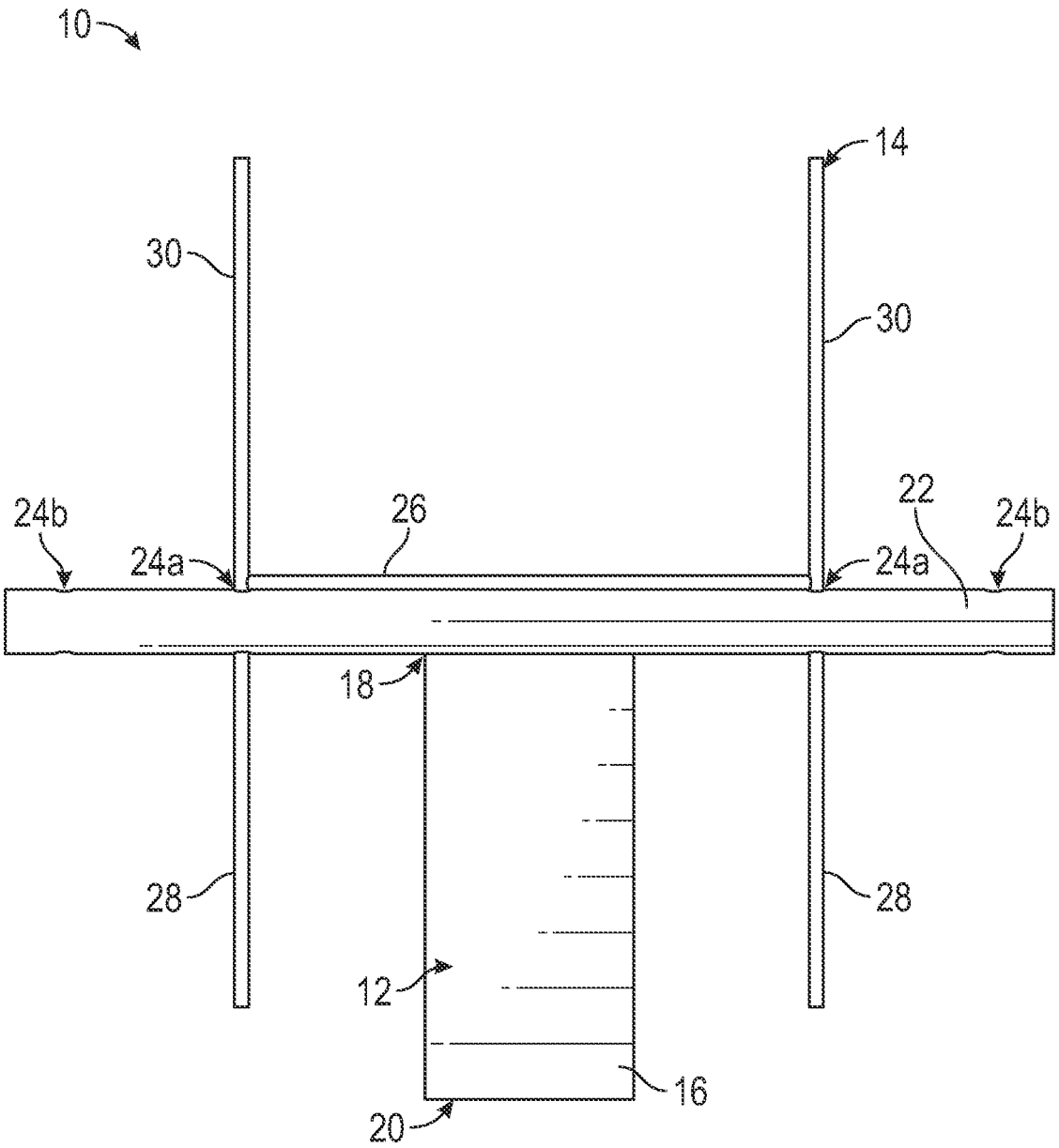
FIG. 9 is a side elevational view of a sign mounting system in accordance with the present disclosure.
Figure 10:
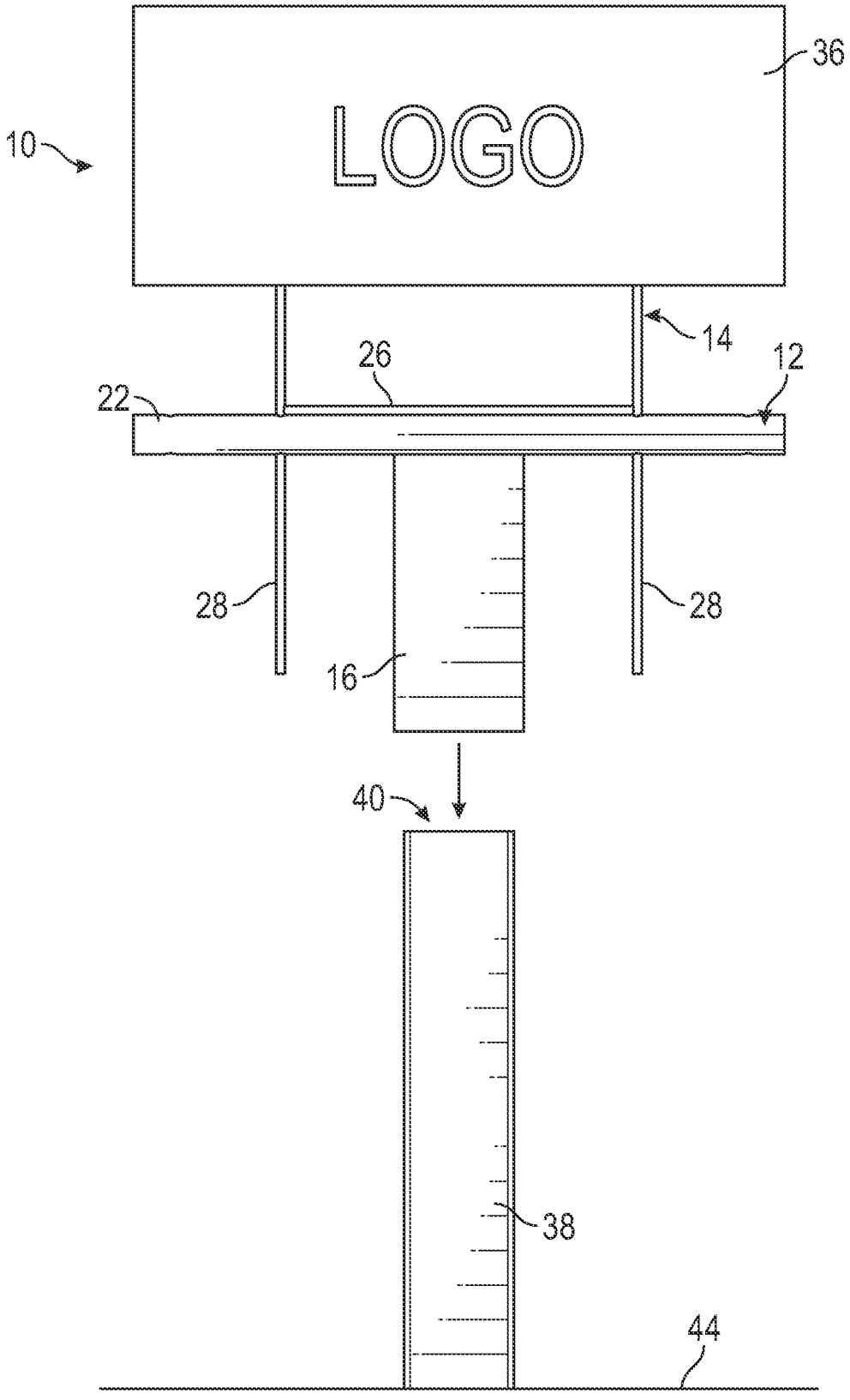
FIG. 10 is an elevational view of a sign mounting system being used to mount a sign onto a vertical stanchion in accordance with the present disclosure.

As best seen in FIGS. 1-2 and 4-5, the bracket 12 comprises a base 16, which is configured to be installed on an upper end 40 of a vertical stanchion 38. The base 16 has a hollow interior volume 42, as best seen in FIGS. 4 and 5. The base 16 has an upper end 18 and a lower end 20. The base 16 preferably has a generally tubular shape extending from the upper end 18 to the lower end 20. The tubular base 16 is vertically oriented when installed on a vertical stanchion 38. FIG. 9 shows the system 10, including the bracket 12 and the sign frame 14, in an upright position with the base 16 of the bracket 12 in a vertically oriented position with the upper end 18 above the lower end 20. FIG. 10 shows the system 10 being utilized to mount a sign 36 onto a stanchion 38, which in this case is a vertical post driven into the ground 44, though the system 10 may be utilized to mount a sign 36 onto any vertical stanchion 38. FIG. 11 shows the vertically oriented base 16 fully installed onto the upper end 40 of the vertical stanchion 38. In a preferred embodiment, as shown in FIG. 1, the base 16 may have a rectangular cross-sectional shape, which may preferably be a square cross-sectional shape, in a horizontal plane dissecting the base 16. The bracket 12 shown in FIG. 1 may be utilized with a stanchion 38 having a rectangular or square cross-sectional shape, such as the stanchion 38 shown in FIGS. 10 and 11. Alternatively, as shown in FIG. 2, the base 16 may have a cylindrical shape. The bracket 12 shown in FIG. 2 may be utilized with a stanchion having a circular cross-sectional shape. It should be understood by one of skill in the art that the base 16 may have different cross-sectional shapes that correspond to stanchions having different cross-sectional shapes and still fall within the scope of the present disclosure. Further, it should be understood by one of skill in the art that the size or internal diameter of the base 16 may vary for use with stanchions of different sizes and still fall within the scope of the present disclosure.

In a preferred embodiment, as best seen in FIGS. 1 and 2, the base 16 has a tubular shape with a continuous side wall, which is preferably either polygonal or circular in shape, that surrounds the interior volume 42 and defines a body having a hollow interior 42. Alternatively, the side wall of the base 16 may have openings therein or may be defined by a caged or meshed enclosure or similar structure that defines a hollow interior, which preferably has an elongated interior volume 42. As shown in FIG. 2, the base 16 may have a side wall with an opening 21 that extends through the side wall and which may optionally be utilized to secure the base 16 to a stanchion 38. The base 16 is preferably elongated from the upper end 18 to the lower end 20 to fit over the upper end 40 of an elongated stanchion 38, and is preferably sufficiently elongated to provide stable support for the bracket 12 and the sign 36 mounted thereon, which may be mounted in an outdoor environment and thus may be subjected to windy conditions. In addition, for a particular stanchion 38 utilized for mounting, a particular bracket 12 may preferably be selected having an internal diameter sized to fit the stanchion 38 in such a way as to minimize the annular space between the interior of the side walls of the base 16 and the exterior of the stanchion 38, which may enhance the stability of the bracket 12 and sign 36 mounted thereon.

As best seen in FIG. 5, the lower end 20 of the base 16 is open so that the bracket 12 may be installed onto the vertical stanchion 38 by inserting the upper end 40 of the stanchion 38 into the lower open end 20 of the base 16. As indicated by the arrow shown in FIG. 10, the bracket 12 may thus be installed onto the stanchion 38 by lowering the bracket 12 onto the upper end 40 of the stanchion 38, which may be fixed in position, with the base 16 surrounding the upper end 40 of the stanchion 38. The upper end 18 of the base 16 is at least partially closed so that the upper end 18 of the base 16 functions as a stopper that rests upon the upper end 40 of the stanchion 38, which supports the bracket 12 on the upper end 40 of the stanchion 38, as best seen in FIG. 11. Thus, with the stanchion 38 fully inserted into the base 16 of the bracket 12 through the lower open end 20 of the base 16 and with the at least partially closed upper end 18 of the base 16 contacting the upper end 40 of the stanchion 38, the base 16 may be utilized to securely support the entire bracket 12 on the stanchion 38 without requiring any additional fastening or other type of attachment. However, additional fastening may optionally be utilized to further secure the base 16 to the stanchion 38. For instance, once the base 16 is installed on the stanchion 38, a screw, bolt, or similar type of fastener may be inserted through opening 21 in the side wall of the base 16 and used to secure the base 16 to the stanchion 38 by threading the fastener into the stanchion 38. Such an opening 21 in the side wall of the base 16 may be utilized with a cylindrical base 16, as shown in FIG. 2, or a base having any other shape, such as the rectangular base 16 as shown in FIG. 1.

Figure 3:
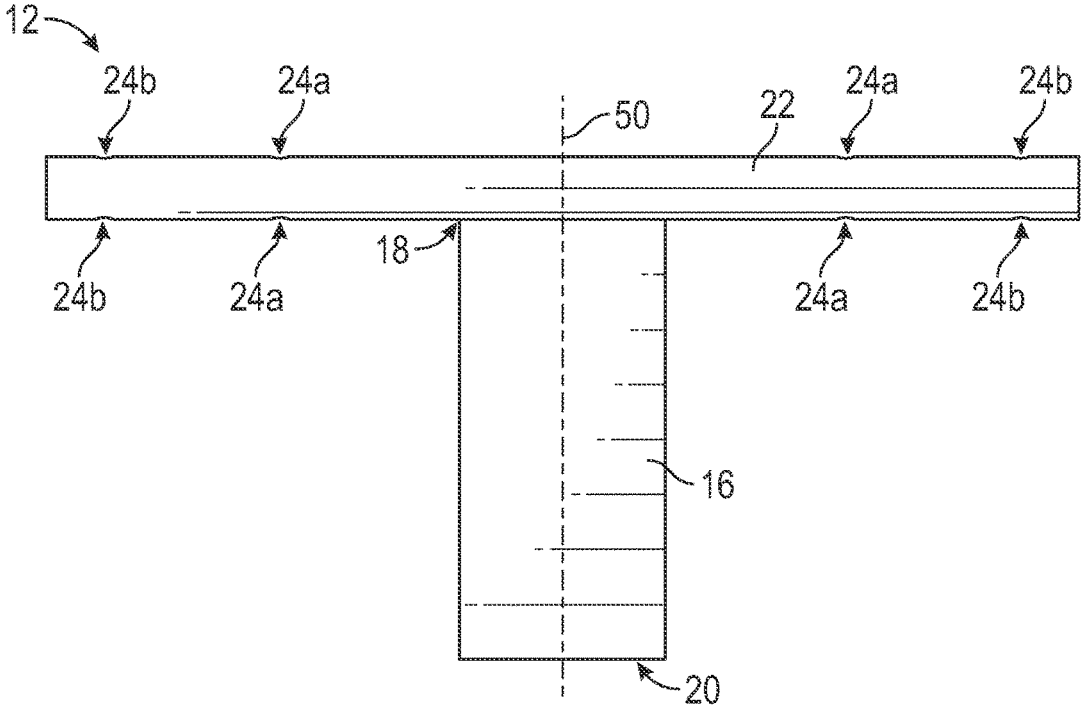
FIG. 3 is a side elevational view of a bracket for use in a sign mounting system in accordance with the present disclosure.

The bracket 12 further comprises a bracket support member 22 attached to the base 16. The bracket support member 22 provides a support structure for the sign frame 14, which in turn supports the sign 36. In a preferred embodiment, as best seen in FIGS. 1-3, the bracket support member 22 is attached to the upper end 18 of the base 16 and is horizontally oriented when the bracket 12 is in an upright position. The bracket support member 22 may preferably comprise a generally straight horizontal rod, which may preferably be attached to a top side of the upper end 18 of the base. In one embodiment, as best seen in FIG. 1, the bracket support member 22 may be utilized to partially close the upper end 18 of the base 16 and thus function as a stopper that contacts the upper end 40 of the stanchion 38 to provide support for the bracket 12 and sign 36, as shown in FIG. 11. The bracket support member 22 may preferably have the shape of a generally cylindrical rod, as best seen in FIG. 1, though the bracket support member 22 may have other cross-sectional shapes. Alternatively, the bracket support member 22 may comprise a generally flat piece of material having a top side and a bottom side that are both horizontally oriented relative to a vertical axis 50 of the base 16. In a preferred embodiment, the bracket support member 22 extends radially outward from the base 16 on opposing sides of the base 16 relative to axis 50. Alternatively, the bracket support member 22 may extend outward from the base 16 on only one side of the base 16.

The bracket support member 22 has a pair of opposing openings 24 that extend through the bracket support member 22. In a preferred embodiment, as best seen in FIG. 3, the bracket support member 22 has a first pair of opposing openings 24*a* and a second pair of opposing openings 24*b*, which may accommodate sign frames 14 of varying sizes. The pairs of openings 24*a* and 24*b* are spaced a distance apart from each other, which is represented by distance 46 and 47, respectively, as illustrated in FIGS. 4 and 5. In a preferred embodiment, as best seen in FIG. 3, the bracket 12 is symmetrical about vertical axis 50 and the openings 24 of each pair of openings 24*a* and 24*b* are equidistant from a center point of the base 16 defined by axis 50. In one preferred embodiment, openings 24*a* may be approximately six inches apart from each other, and openings 24*b* may be approximately ten inches apart from each other. In a preferred embodiment, as best seen in FIGS. 4 and 5, each of the openings 24 of each pair of openings 24*a* and 24*b* extends vertically through the bracket support member 22. Thus, each of the openings 24 preferably extends from a top side of the bracket support member 22 to a bottom side of the bracket support member 22 in a vertical direction that is parallel to axis 50. Each opening 24 preferably has a circular shape, which may be formed by drilling through the bracket support member 22, though other shapes may be utilized.

Figures 6, 7, 8:
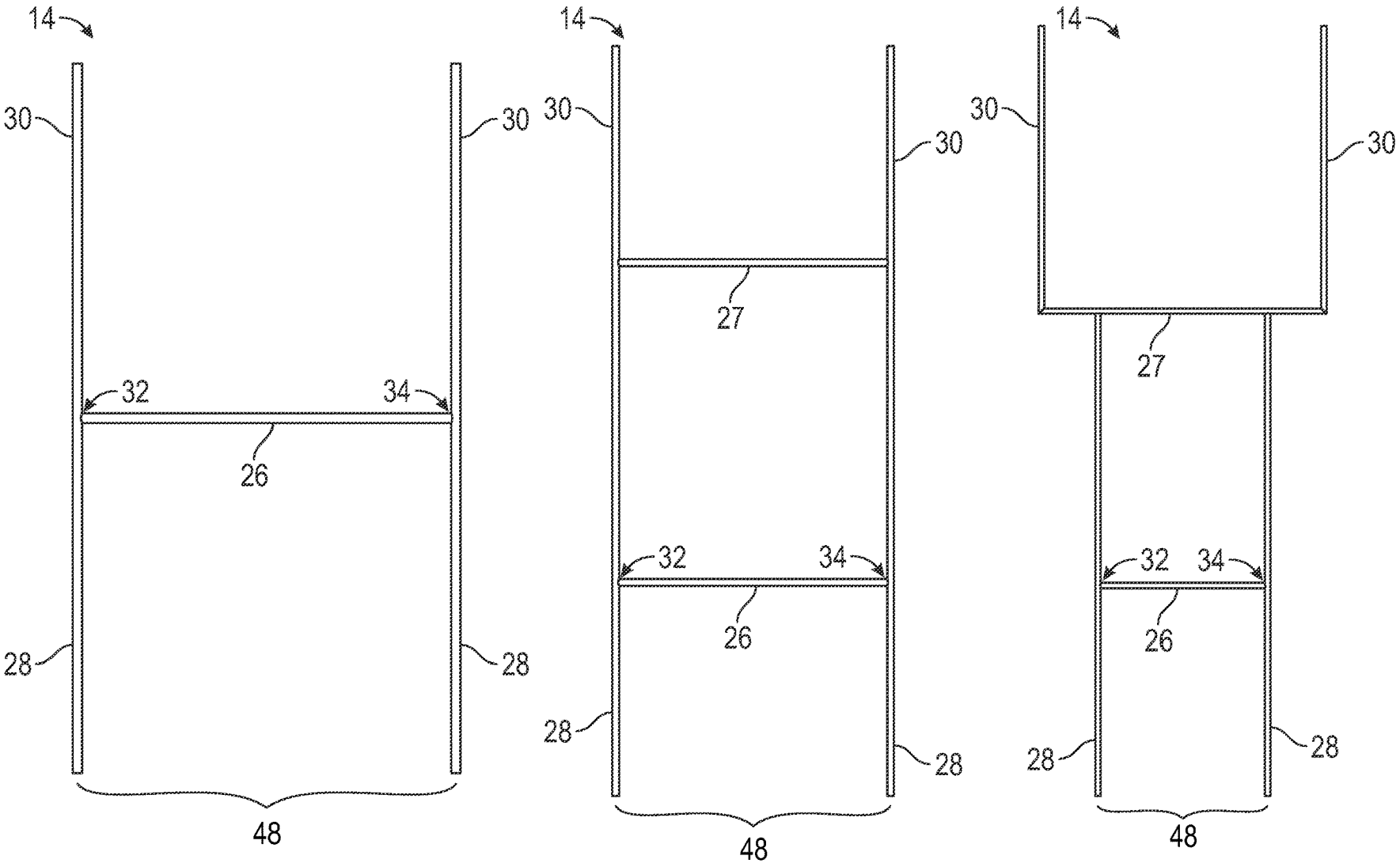
FIG. 6 is a side elevational view of a sign frame for use in a sign mounting system in accordance with the present disclosure.
FIG. 7 is a side elevational view of a sign frame for use in a sign mounting system in accordance with the present disclosure.
FIG. 8 is a side elevational view of a sign frame for use in a sign mounting system in accordance with the present disclosure.

As best seen in FIG. 10, the sign frame 14 may be mounted onto the bracket 12 to support a sign 36 in an upright position for viewing. FIGS. 6-8 show illustrative embodiments of different sign frames 14 that may be utilized with the system 10 to mount a sign 36 onto a stanchion 38 using the bracket 12. The sign frame 14 comprises a frame cross support member 26 and two opposing sign mounting rods 28 each attached to the frame cross support member 26. Each of the sign mounting rods 28 extends downwardly from the frame cross support member 26. Further, each sign mounting rod 28 is sized for insertion into one respective opening 24 of the pairs of openings 24*a* and 24*b*. The sign frame 14 may be mounted onto the bracket 12 by inserting the two sign mounting rods 28 downward into and through two of the openings 24 of the bracket support member 22, as shown in FIGS. 9-11. Thus, the sign frame 14 and the bracket 12 are separate components of the system 10 and do not require any additional fastening other than insertion of mounting rods 28 into openings 24 in order to mount the sign frame 14 onto the bracket 12.

As illustrated in FIGS. 6-8, the sign mounting rods 28 are spaced a distance 48 apart from each other. It should be understood that the sign frames 14 shown in FIGS. 6-8 are not shown to scale. The distance 48 by which the sign mounting rods 28 are spaced apart from each other is approximately equal to the distance 46 by which opposing openings 24*a* of the bracket support member 22 are spaced apart from each other or the distance 47 by which opposing openings 24*b* are spaced apart from each other. Thus, the bracket support member 22 preferably has more than one pair of openings 24 with different spacings (e.g., distance 46 or distance 47), that support sign frames 14 having sign mounting rods 28 with different spacing distances 48, which may correspond to distance 46 or distance 47. Both of the sign mounting rods 28 of a sign frame 14 may be inserted downward simultaneously into and through both of openings 24*a* or openings 24*b* to mount the sign frame 14 onto the bracket 12. Both the sign mounting rods 28 and the openings 24 in the bracket support member 22 are preferably circular in shape, with the openings 24 each having an inner diameter that is slightly larger than an outer diameter of each sign mounting rod 28 to allow insertion of the sign mounting rods 28 into the openings 24. The sign mounting rods 28 are preferably generally straight rods that are disposed in a position generally parallel to each other, and the openings 24 in the bracket support member 22 are preferably vertically oriented so that the sign 36 may be mounted in a generally vertical position by inserting the sign mounting rods 28 downward into the openings 24. The sign mounting rods 28 may preferably be fully inserted through the openings 24 until the frame cross support member 26 contacts the bracket support member 22, as best seen in FIG. 9, when mounting the sign frame 14 onto the bracket 12.

As shown in FIGS. 10 and 11, the sign frame 14 is utilized to support a sign 36 for viewing. In a preferred embodiment, the sign 36 may be a corrugated sign having spaces between internal corrugations, which are disposed between a front surface and a rear surface of the sign 36. To support such a corrugated sign 36, the sign frame 14 preferably has two opposing sign mounting rods 30 each attached to the frame cross support member 26, as shown in FIGS. 6-8. The sign mounting rods 30 may be used to attach the sign 36 to the sign frame 14 by inserting the sign mounting rods 30 into the spaces between the internal corrugations of the sign 36. Each of the sign mounting rods 30 extends upwardly from the frame cross support member 26 and has a free upper end that may be inserted into the internal corrugations of the sign 36. It should be understood that other suitable methods of attaching a sign 36 to the sign frame 14 may be utilized. Once the sign 36 is attached to the sign frame 14, the sign frame 14 may be used to support the sign 36 in an upright position. In a preferred embodiment, the frame cross support member 26 comprises a generally straight rod having two opposing ends 32 and 34, and each frame mounting rod 28 is attached to the frame cross support member 26 at a respective opposing end 32 and 34 of the frame cross support member 26. Each frame mounting rod 28 is preferably positioned at approximately a 90-degree angle to the frame cross support member 26. In some embodiments, as shown in FIGS. 7 and 8, the sign frame 14 may include a second cross support member 27, which may be utilized for additional structural support for sign frames 14 of increased height. In a preferred embodiment, as shown in FIGS. 6 and 7, a single straight rod may define one of both a frame mounting rod 28 and a sign mounting rod 30 with the frame cross support member 26 being attached to a midpoint of the single rod 28, 30, as shown in FIG. 6, or at another point between upper and lower ends of the rod 28, 30, as shown in FIG. 7, which may also include a second cross support member 27. The second cross support member 27 is preferably positioned above the first cross support member 26 and parallel to the first cross support member 26. Alternatively, as shown in FIG. 8, the sign mounting rods 30 may comprise separate rods from the frame mounting rods 28 and may be attached directly to opposing ends of the second cross support member 27, which may be longer than the first cross support member 26.

Figure 12:
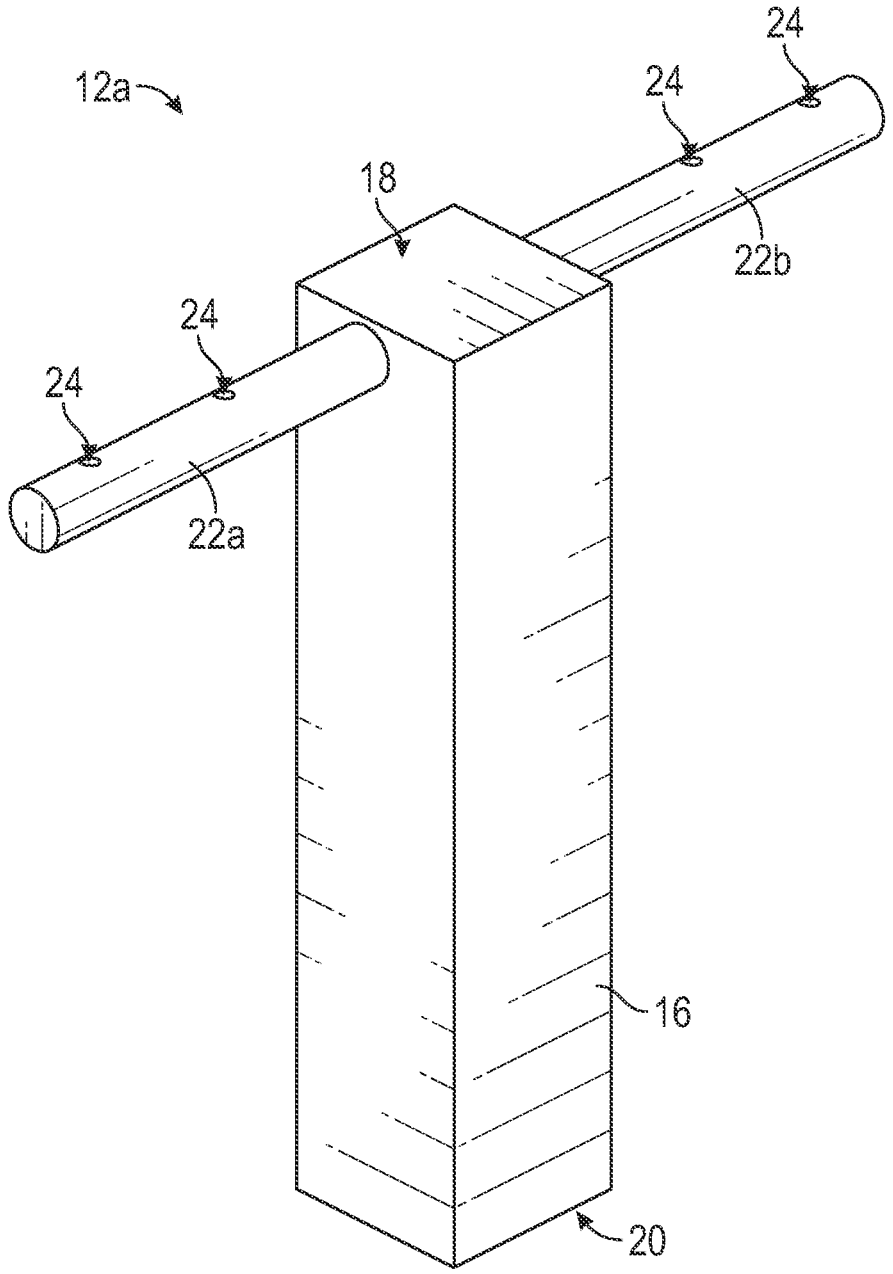
FIG. 12 is a perspective view of a bracket for use in a sign mounting system in accordance with the present disclosure.

FIG. 12 illustrates an alternative embodiment of the bracket 12*a*. The bracket 12*a* comprises a base 16 having a hollow interior 42. The base 12*a* has a lower end 20 that is open and an upper end 18 that is at least partially closed and may preferably be fully closed. The bracket 12*a* further comprises first and second opposing bracket support members 22*a* and 22*b* attached to opposing sides of the base 16 and extending radially outward from the base 16. Each bracket support member 22*a* and 22*b* has an opening 24 that extends through the bracket support member 22*a*, 22*b*, and the opening 24 of the first bracket support member 22*a* is spaced a distance apart from the opening 24 of the second bracket support member 22*b*, which is approximately equal to the distance 48 by which the frame mounting rods 28 are spaced apart from each other. Similar to bracket 12, each bracket support member 22*a* and 22*b* preferably has more than one opening 24 to accommodate sign frames 14 of different sizes. In a preferred embodiment, each opening 24 of the bracket support member 22 of bracket 12 and each opening 24 of the bracket support members 22*a*, 22*b* of bracket 12*a* have upper open ends that are generally in the same horizontal plane relative to vertical axis 50 as those of other openings 24 of the same bracket 12, 12*a* when the bracket 12, 12*a* is in the upright position. Each opening 24 is preferably also vertically oriented when the bracket 12, 12*a* is in an upright position. It should be understood by one of skill in the art that bracket support member 22 of bracket 12 or bracket support members 22*a* and 22*b* of bracket 12*a* may take various forms, shapes, or configurations and may be attached to the base 16 in different locations to provide spaced openings 24 extending through the bracket support member 22, 22*a*, 22*b* that spatially correspond to a sign frame 14 having frame mounting rods 28 at a defined distance 48 apart from each other so that the frame mounting rods 28 may be inserted into the openings 24 to securely mount the sign frame 14 onto the bracket 12, 12*a*. It should be further understood by one of skill in the art that each of these embodiments would fall within the scope of the present disclosure.

In an alternative embodiment, more than one bracket 12 may be utilized to mount a wide sign frame 14 having frame mounting rods 28 spaced farther apart from each other than the openings 24 of a bracket support member 22 of a single bracket 12. For instance, two brackets 12 may each be installed respectively on adjacent stanchions 38 that are spaced apart from each other, such as posts of a fence or similar structure. One of the frame mounting rods 28 of the sign frame 14 may then be inserted into one of the openings 24 of the first bracket 12, and the other frame mounting rod 28 of the same sign frame 14 may then be inserted into one of the openings 24 of the second bracket 12 to mount a sign 36 onto two adjacent stanchions 38.

It is understood that versions of the present disclosure may come in different forms and embodiments. Additionally, it is understood that one of skill in the art would appreciate these various forms and embodiments as falling within the scope of the invention as disclosed herein.

What is claimed is:

1. A sign mounting system, comprising:

a bracket and a sign frame, wherein the bracket comprises:

a base having a hollow interior, wherein the base has an upper end and a lower end, wherein the lower end of the base is open, wherein the upper end of the base is at least partially closed, and a bracket support member attached to the base, wherein the bracket support member has a pair of opposing openings that extend through the bracket support member, wherein the pair of openings are spaced a distance apart from each other, and wherein the sign frame comprises:

a frame cross support member and two opposing frame mounting rods each attached to the frame cross support member, wherein each of the frame mounting rods extends downwardly from the frame cross support member, wherein the frame mounting rods are spaced apart from each other by a distance approximately equal to the distance by which the pair of openings of the bracket support member are spaced apart from each other, and wherein each frame mounting rod is sized for insertion into one respective opening of the pair of openings.

2. The system of claim 1, wherein the base of the bracket has a rectangular cross-sectional shape.

3. The system of claim 1, wherein the base of the bracket has a cylindrical shape.

4. The system of claim 1, wherein the frame mounting rods of the sign frame are disposed in a position generally parallel to each other.

5. The system of claim 1, wherein the bracket support member is attached to the upper end of the base of the bracket.

6. The system of claim 1, wherein the bracket support member comprises a generally straight rod that is horizontally oriented when the bracket is in an upright position.

7. The system of claim 1, wherein the bracket support member extends radially outward from the base on opposing sides of the base.

8. The system of claim 7, wherein the pair of openings are equidistant from a center point of the base.

9. The system of claim 1, wherein each opening of the pair of openings extends vertically through the bracket support member when the bracket is in an upright position.

10. The system of claim 1, wherein the frame cross support member comprises a generally straight rod having two opposing ends, wherein each frame mounting rod is attached to the frame cross support member at a respective opposing end of the frame cross support member, and wherein each frame mounting rod is positioned at a 90-degree angle to the frame cross support member.

11. The system of claim 1, wherein the sign frame further comprises two opposing sign mounting rods each attached to the frame cross support member, wherein each of the sign mounting rods extends upwardly from the frame cross support member.

12. The system of claim 11, further comprising a sign mounted onto the sign mounting rods.

13. The system of claim 1, further comprising a stanchion having an upper end, wherein the upper end of the stanchion is inserted into the open lower end of the base of the bracket.

14. The system of claim 1, wherein the base of the bracket comprises a side wall having an opening that extends through the side wall.

15. A sign mounting system, comprising:

a bracket and a sign frame, wherein the bracket comprises:

a base having a hollow interior, wherein the base has an upper end and a lower end, wherein the lower end of the base is open, wherein the upper end of the base is at least partially closed, and first and second opposing bracket support members attached to opposing sides of the base, wherein each bracket support member has an opening that extends through the bracket support member, wherein the opening of the first bracket support member is spaced a distance apart from the opening of the second bracket support member, and wherein the sign frame comprises:

a frame cross support member and two opposing frame mounting rods each attached to the frame cross support member, wherein each of the frame mounting rods extends downwardly from the frame cross support member, wherein the frame mounting rods are spaced apart from each other by a distance approximately equal to the distance by which the openings of the first and second bracket support members are spaced apart from each other, and wherein each frame mounting rod is sized for insertion into one respective opening of the bracket support members.

16. The system of claim 15, wherein each bracket support member comprises a generally straight rod that is horizontally oriented when the bracket is in an upright position.

17. The system of claim 15, wherein each opening extends vertically through one respective bracket support member when the bracket is in an upright position.

18. The system of claim 15, wherein the frame cross support member comprises a generally straight rod having two opposing ends, wherein each frame mounting rod is attached to the frame cross support member at a respective opposing end of the frame cross support member, and wherein each frame mounting rod is positioned at a 90-degree angle to the frame cross support member.

19. A method of mounting a sign, said method comprising the steps of:

providing a sign mounting system comprising a bracket and a sign frame, wherein the bracket comprises:

a base having a hollow interior, wherein the base has an upper end and a lower end, wherein the lower end of the base is open, wherein the upper end of the base is at least partially closed, and a bracket support member attached to the base, wherein the bracket support member has a pair of opposing openings that extend through the bracket support member, wherein the pair of openings are spaced a distance apart from each other, and wherein the sign frame comprises:

a frame cross support member and two opposing frame mounting rods each attached to the frame cross support member, wherein each of the frame mounting rods extends downwardly from the frame cross support member, wherein the frame mounting rods are spaced apart from each other by a distance approximately equal to the distance by which the pair of openings of the bracket support member are spaced apart from each other, and wherein each frame mounting rod is sized for insertion into one respective opening of the pair of openings, attaching a sign to the sign frame, installing the bracket onto a vertical stanchion by inserting an upper end of the stanchion into the open lower end of the base of the bracket, and installing the sign frame onto the bracket by inserting each frame mounting rod downward through one respective opening of the pair of openings of the bracket support member.

20. The method of claim 19, wherein the sign frame further comprises two opposing sign mounting rods each attached to the frame cross support member, wherein each of the sign mounting rods extends upwardly from the frame cross support member, wherein the step of attaching the sign to the sign frame comprises inserting the sign mounting rods into spaces between internal corrugations of the sign.

* * * * *